US007600749B2

(12) United States Patent
Lee et al.

(10) Patent No.: US 7,600,749 B2
(45) Date of Patent: Oct. 13, 2009

(54) PAPER FEEDING DEVICE AND IMAGE FORMING APPARATUS INCLUDING THE SAME

(75) Inventors: Jin-soo Lee, Suwon-si (KR); Jae-hak Lee, Gumi-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 274 days.

(21) Appl. No.: 11/233,040

(22) Filed: Sep. 23, 2005

(65) Prior Publication Data

US 2006/0180998 A1 Aug. 17, 2006

(30) Foreign Application Priority Data

Dec. 20, 2004 (KR) ..... 10-2004-0108809

(51) Int. Cl.
*B65H 1/00* (2006.01)

(52) U.S. Cl. ..... 271/145; 271/171; 399/393

(58) Field of Classification Search ..... 271/171, 271/145; 399/393
See application file for complete search history.

(56) References Cited

U.S. PATENT DOCUMENTS 6,332,610 B1 * 12/2001 Hiura ..... 271/171

FOREIGN PATENT DOCUMENTS

| | | | |
|---|---|---|---|
| EP | 1 264 791 | A1 | 6/2002 |
| JP | 02095628 | A * | 4/1990 |
| JP | 06-255810 | | 9/1994 |
| JP | 09-216738 | | 8/1997 |
| JP | 10-139175 | | 5/1998 |
| JP | 10-175742 | | 6/1998 |
| JP | 2000-025963 | | 1/2000 |
| JP | 2002-265070 | | 9/2002 |

* cited by examiner

*Primary Examiner*—Patrick H Mackey
*Assistant Examiner*—Luis Gonzalez
(74) *Attorney, Agent, or Firm*—Roylance, Abrams, Berdo & Goodman, L.L.P.

(57) ABSTRACT

A paper feeding device includes a guide member that guides both sides of a sheet of paper stacked in a paper feeding cassette and a support unit that prevents the guide members from being moved due to inertia of sheets of paper during installation of the paper feeding cassette. Accordingly, the paper feeding device contacts and supports one side of the guide unit and prevents the guide unit from being moved. Therefore, a sheet of paper may prevented from being separated from a finger during installation of the paper feeding cassette. Furthermore, a paper jam or skew due to the separation of the paper may be prevented.

20 Claims, 14 Drawing Sheets

PAPER FEEDING DEVICE AND IMAGE FORMING APPARATUS INCLUDING THE SAME

CROSS-REFERENCE TO RELATED PATENT APPLICATIONS

This application claims the benefit under 35 U.S.C. § 119 (a) of Korean Patent Application No. 10-2004-0108809, filed on Dec. 20, 2004, in the Korean Intellectual Property Office, the entire disclosure of which is hereby incorporated by reference.

BACKGROUND OF THE INVENTION

1. Field of the Invention

The present invention relates to a paper feeding device and an image forming apparatus including the paper feeding device. More particularly, the present invention relates to a paper feeding device of a center feeding type that prevents a sheet of paper from being separated from a finger during installation of the paper feeding device and an image forming apparatus including the paper feeding device.

2. Description of the Related Art

Generally, an image forming apparatus, such as a laser beam printer, an LED (light emitting diode) printer, a digital copier, and a fax machine, produces a monochromatic image or a color image by forming an electrostatic latent image corresponding to a desired image by scanning light onto a photosensitive medium charged to a uniform electrostatic potential. The latent image is then developed by providing developer on the photosensitive medium, and is transferred and fused to a sheet of print paper or an intermediate transfer belt.

The image forming apparatus includes a paper feeding device to feed a sheet of paper. The paper feeding device includes a guide member that guides paper having different widths without paper misalignment.

When a sheet of paper is transferred based on one side of the paper, only the guide member is adjusted to the width of paper and the sheet of paper is transferred (this is referred to as 'side feeding type'). When a sheet of paper is transferred based on the center of the paper, guide members on both sides of paper are set to the width of the paper and the sheet of paper is transferred while the guide members are facing each other (this is referred to as 'center feeding type').

Generally, a paper feeding device of a center feeding type includes a guide member having a pair of guide units to guide both sides of the paper. The guide units are engaged with a pinion gear such that when one of the guide unit and the pinion gear is moved, the other guide unit is moved in association with the movement of the guide unit or the pinion gear. Such a paper feeding device in a printer, copier, or fax machine for office use stores sheets of paper with various sizes, such as A4 sized paper, letter sized paper, and the like.

FIG. 1 is a view of a conventional paper feeding device 10 in which sheets of paper S are stored and pressed by fingers 20. FIG. 2 is a view of the paper feeding device 10 of FIG. 1 that is empty. FIG. 3 is a view of the paper feeding device 10 of FIG. 1 when a sheet of paper S is separated from the fingers 20.

Referring to FIGS. 1-3, the paper feeding device 10 includes a paper feeding cassette 12 and guide units 15. Fingers 20 that are used as paper separation means are installed in the paper feeding cassette 12. The fingers 20 are mounted on both sides of the paper feeding cassette 12 and separate sheets of paper S picked up one by one by a pick-up roller (not shown). A pair of guide units 15 are installed to slide in the direction of the width of a sheet of paper S and to guide both sides of the sheet of paper S stacked in the paper feeding cassette 12.

The conventional paper feeding device 10 has a gap A of a predetermined width between a sidewall of the paper feeding cassette 12 and the guide unit 15, as shown in FIG. 2.

When the paper feeding device 10 is installed in an image forming apparatus after storing sheets of paper therein, a force due to inertia of the sheets of paper is transmitted to a sidewall of the guide unit 15 in an installation direction of the paper feeding device 10. Therefore, the guide unit 15 is pushed in the travel direction of paper S or shaken. Accordingly, the sheet of paper S is undesirably separated from the fingers 20 to the upper side. Since the sheet of paper S is separated from the fingers 20, the fingers 20 cannot function as paper separation means and a paper jam or skew occurs when a sheet of paper is transferred.

In the conventional paper feeding device 10, the guide units 15 cannot be fixed due to the gap A between a sidewall of the paper feeding cassette 12 and each guide unit 15, and therefore a sheet of paper S is separated from the fingers 20 due to the moving of the guide units 15 when the paper feeding device 10 is installed.

Accordingly, a need exists for an image forming apparatus having a paper feeding device that prevents paper from being separated from a finger of the paper feeding cassette during installation of the paper feeding device, thereby substantially preventing paper jams and skews when printing with the image forming apparatus.

SUMMARY OF THE INVENTION

The present invention provides a paper feeding device that substantially prevents the moving of guide units during installation of the paper feeding device and an image forming apparatus including the same.

According to an aspect of the present invention, a paper feeding device for an image forming apparatus includes a paper feeding cassette in which sheets of paper are stacked. A pinion gear is rotatably installed in the paper feeding cassette. A guide member is connected to the pinion gear that slides rearwardly and forwardly in a direction of a width of the sheet of paper and that guides both sides of the sheet of paper. A support unit supports one side of the guide member corresponding to the size of the stacked sheets of paper.

The guide member may include a pair of guide units guiding both sides of the sheet of paper.

The paper feeding cassette may be installed in and removed from the image forming apparatus in a direction substantially perpendicular to the direction of paper travel.

The support unit may include at least one or more connection holes formed in a sidewall of the paper feeding cassette that penetrate the sidewall. A guide stopper is inserted in and connected to the connection hole and contacts and supports one side of the guide unit according to the size of the stacked sheet of paper.

The sidewall of the paper feeding cassette may be formed such that one side of the guide unit contacts the sidewall of the paper feeding cassette and guides a side of a sheet of paper when the sheets of paper of the maximum size that may be contained are stacked in the cassette.

A protruding portion may be formed on the sidewall of the paper feeding cassette to protrude in a direction in which the sheet of paper is stacked. Some of the connection holes may be formed in the protruding portion.

The most protruding portion may be formed such that one side of the guide unit contacts the most protruding portion and guides a side of a sheet of paper when the sheets of paper of the maximum size that may be contained are stacked in the cassette.

The guide stopper may have various lengths corresponding to the size of the stacked sheets of paper.

The guide stopper may be locked in and disconnected from the connection hole by a rotation motion.

The guide stopper may be screw-connected to the connection hole and installed to move rearwardly and forwardly in a direction parallel to the direction in which the guide unit slides.

According to another aspect of the present invention, an image forming apparatus includes a paper feeding device that provides a sheet of paper. The paper feeding device includes a paper feeding cassette in which sheets of paper are stacked. A pinion gear is rotatably installed in the paper feeding cassette. A pair of guide units are connected to the pinion gear that slide rearwardly and forwardly in a direction of a width of the sheet of paper and that guide both sides of the sheet of paper. A support unit supports one side of the guide unit.

The support unit may include at least one or more connection holes formed in a sidewall of the paper feeding cassette that penetrate the sidewall. A guide stopper is inserted in and connected to the connection hole and contacts and supports one side of the guide unit according to the size of the stacked sheet of paper.

The sidewall of the paper feeding cassette may be formed such that one side of the guide unit contacts the sidewall of the paper feeding cassette and guides a side of a sheet of paper when the sheets of paper of the maximum size that may be contained are stacked in the cassette.

A protruding portion may be formed on the sidewall of the paper feeding cassette to protrude in a direction in which the sheet of paper is stacked. Some of the connection holes may be formed in the protruding portion.

The most protruding portion may be formed such that one side of the guide unit contacts the most protruding portion and guides a side of a sheet of paper when the sheets of paper of the maximum size that may be contained are stacked in the cassette.

The guide stopper may have various lengths corresponding to the size of the stacked sheets of paper.

The guide stopper may be screw-connected to the connection hole and installed to move rearwardly and forwardly in a direction parallel to the direction in which the guide unit slides.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Figure 1:
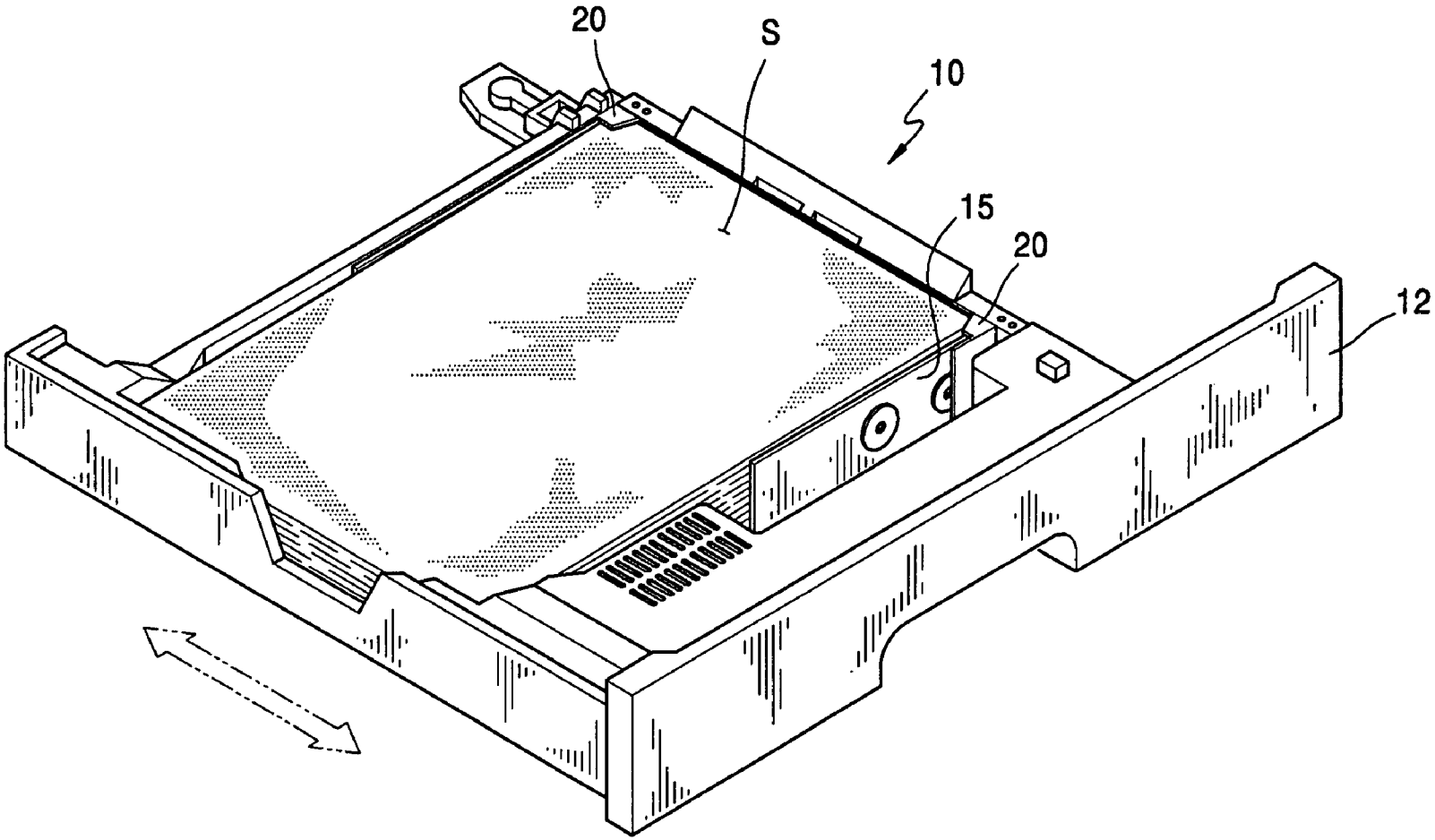
FIG. 1 (PRIOR ART)
FIG. 1 is a perspective view of a conventional paper feeding device in which sheets of paper are stored and pressed by fingers.
Figure 2:
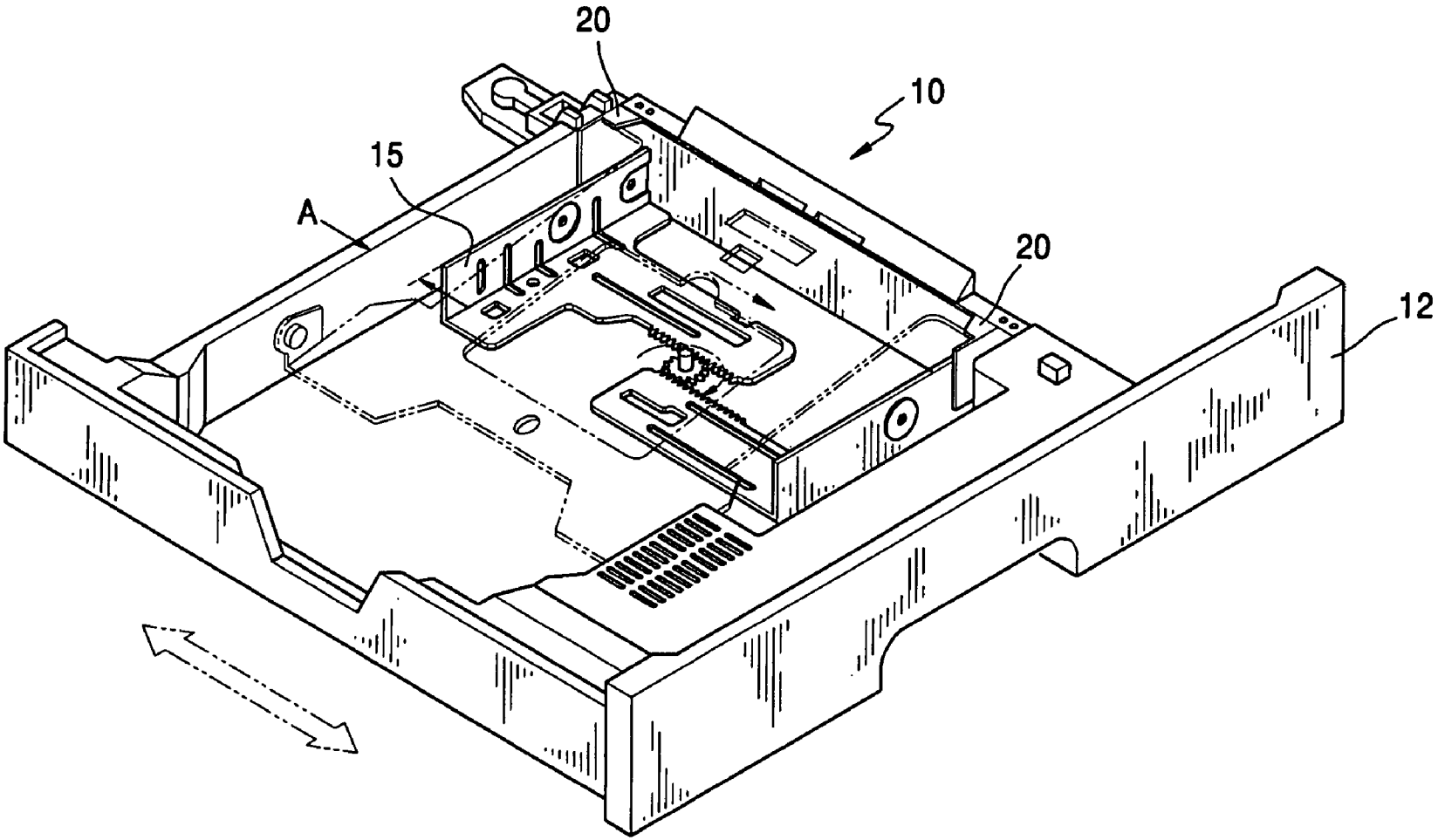
FIG. 2 (PRIOR ART)
FIG. 2 is a perspective view of an empty paper feeding device of FIG. 1.
Figure 3:
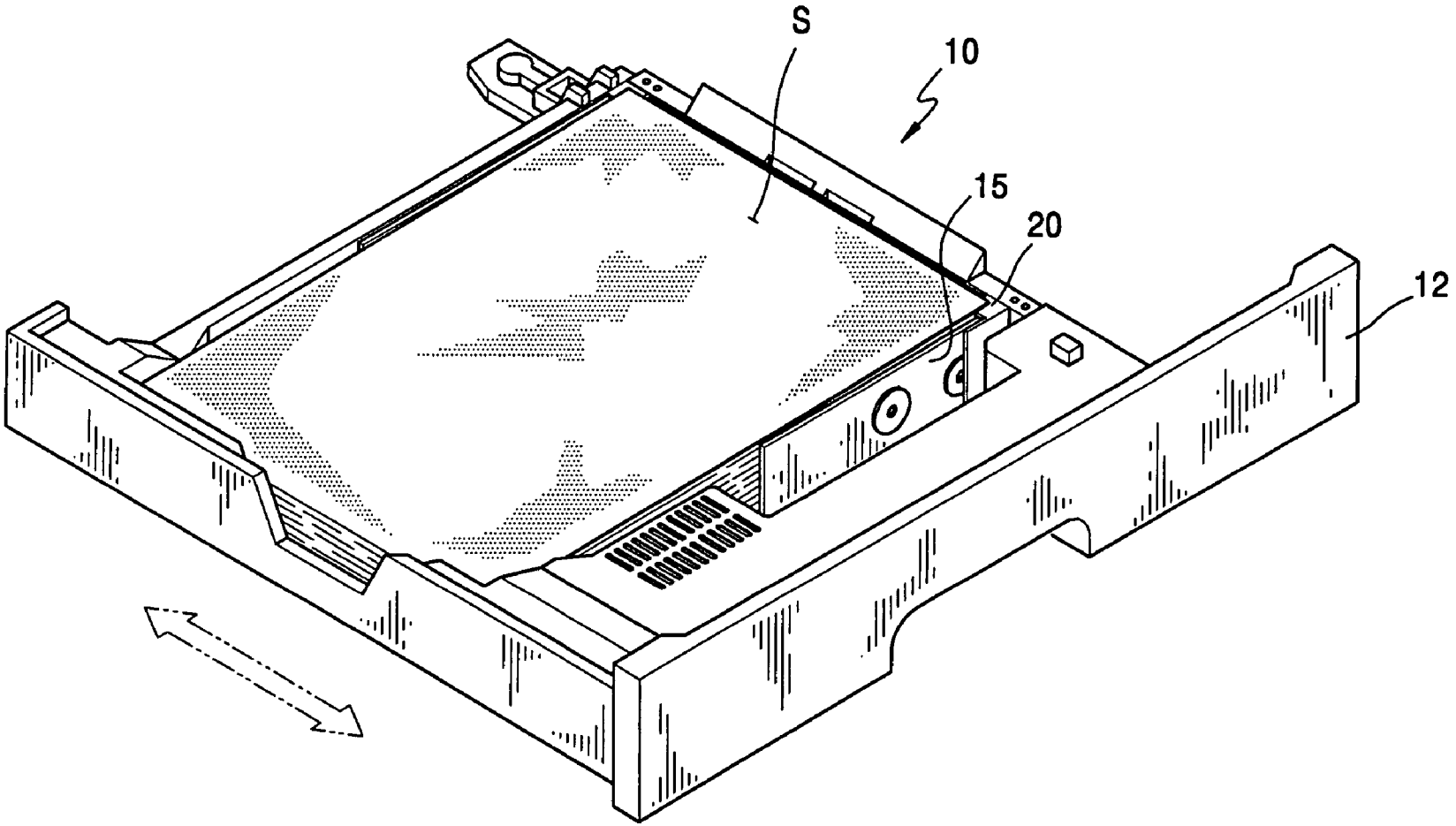
FIG. 3 (PRIOR ART)
FIG. 3 is a perspective view of the paper feeding device of FIG. 1 when a sheet of paper is separated from the fingers.

The present invention is described with reference to the accompanying drawings in which exemplary embodiments of the invention are shown. In the drawings, the thickness of lines, the shapes of the elements, and so forth, are exaggerated for clarity of the description. For the same reasons, an image forming apparatus including a paper feeding device is described prior to the paper feeding device, and in the exemplary embodiments of the present invention, the electrophotographic image forming apparatus is described as an example of the present invention, but the present invention is not limited thereto.

Figure 4:
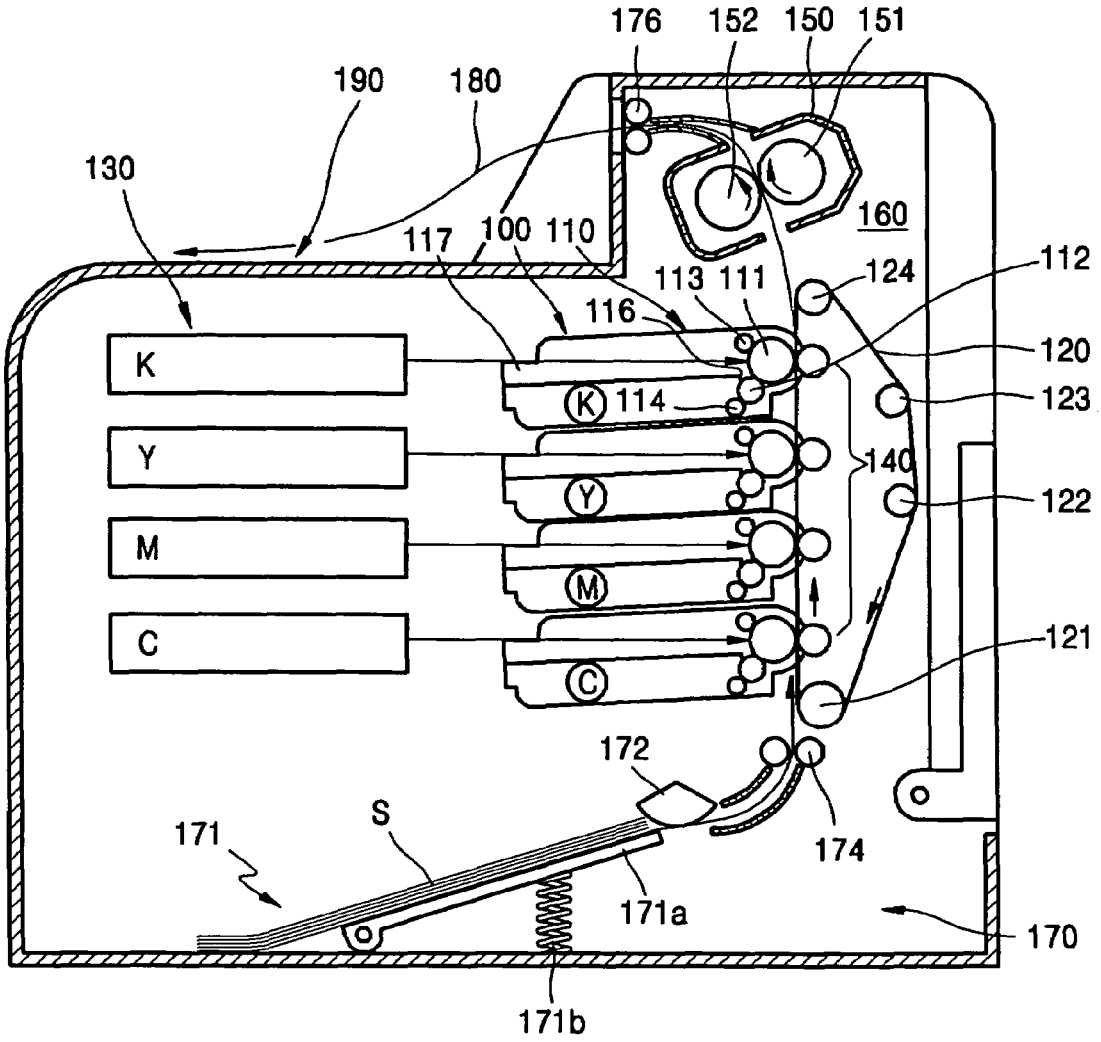
FIG. 4 is a cross-sectional diagram of an image forming apparatus according to an exemplary embodiment of the present invention.

FIG. 4 is a cross-sectional diagram of an image forming apparatus according to an exemplary embodiment of the present invention.

Referring to FIG. 4, the image forming apparatus includes a print unit 160 that prints an image onto a sheet of paper S by an electrophotographic process and a paper feeding device 170 that feeds a sheet of paper to the print unit 160.

The print unit 160 includes four developer cartridges 110C, 110M, 110Y and 110K that respectively contain ink of different colors, for example, cyan (C), magenta (M), yellow (Y) and black (K) colors. The print unit 160 also has a conveying belt 120, scanning units 130C, 130M, 130Y and 130K, transfer rollers 140 and a fuser 150.

The conveying belt 120 circulates while being supported by a plurality of support rollers 121, 122, 123 and 124. In this exemplary embodiment, the conveying belt 120 is installed in a vertical direction. Each scanning unit 130C, 130M, 130Y and 130K scans light corresponding to image data of cyan (C), magenta (M), yellow (Y) and black (K) colors onto each photoreceptor drum 111 of the developer cartridges 110C, 110M, 110Y and 110K.

Each of the developer cartridges 110C, 110M, 110Y and 130K includes a photoreceptor drum 111, a developing roller 112, an electrostatic charging roller 113, a supply roller 114, a toner layer regulating member 116, a cleaning member (not shown), and a storage unit (not shown). The photoreceptor drum 111 circulates while a part of the outer surface thereof is exposed, and the outer circumference is coated with a photoconductive material layer.

A charging bias voltage is applied to the electrostatic charging roller 113 so that the outer circumference of the photoreceptor drum 111 is charged to a uniform electrostatic potential. Instead of the electrostatic charging roller 113, a corona discharger (not illustrated) may be used.

The developing roller 112 provides toner to the photoreceptor drum 111 by sticking the toner on the outer circumference thereof. The developing roller 112 contains toner in solid powder form, and develops a toner image by providing the toner on an electrostatic latent image formed on the photoreceptor drum 111. A developing bias voltage is applied to the developing roller 112 to supply the toner to the photoreceptor drum 111.

In a frame 100, the supply roller 114 that adheres toner to the developing roller 112 and the toner layer regulating member 116 that regulates the quantity of toner adhered to the developing roller 112 are installed on the outer surface of the developing roller 112.

Each of the developer cartridges 110C, 110M, 110Y and 110K may further include an agitator (not shown) that transfers toner contained therein to the supply roller 114 and/or the developing roller 112.

According to the exemplary embodiment, each of the developer cartridges 110C, 110M, 110Y and 110K includes an opening 117 that forms a passage for scanning light from the scanning unit 130C, 130M, 130Y or 130K on the photoreceptor drum 111. The outer circumference surfaces of the photoreceptor drums 111 face the conveying belt 120.

The four transfer rollers 140 are preferably disposed such that the conveying belt 120 is positioned between the photoreceptor drums 111 of the developer cartridges 110C, 110M, 110Y and 110K and the four transfer rollers 140. A transfer bias voltage of opposite polarity to the toner image is applied to the transfer rollers 140 so that the toner image developed on the photoreceptor drum 111 is transferred to a sheet of paper S. The toner image is transferred to the sheet of paper S by an electrostatic force between the photoreceptor drum 111 and the transfer rollers 140.

The fuser 150 includes a heating roller 151 and a pressure roller 152, and fixes the toner image formed on the sheet of paper S by applying heat and pressure thereon. The heating roller 151 for fixing the toner image is installed facing the pressure roller 152 in an axial direction. The pressure roller 152 is also installed to face the heating roller 151, and fixes the toner image to a sheet of paper S by applying high pressure to the sheet of paper S.

The sheet of paper S to which the toner image has been fixed is discharged outside the image forming apparatus by discharging rollers 176. The sheet of paper S is moved along a paper transfer path 180 from the print unit 160, discharged by the discharging rollers 176, and stacked on a stacking portion 190.

The image forming apparatus includes the paper feeding device 170 preferably disposed in the lower part of the image forming apparatus that feeds a sheet of paper S to the print unit 160. The paper feeding device 170 includes a paper feeding cassette 171 that contains sheets of paper. A multipurpose feeder (MPF, not shown) may also be included in the image forming apparatus to additionally feed a sheet of paper. The MPF is generally used to feed over head projector (OHP) paper or non-standardized size paper.

The paper feeding cassette 171, which is an example of a paper storing member, includes a knock-up plate 171*a* on which sheets of paper S are stacked and a spring member 171*b* that resiliently biases the knock-up plate 171*a* upwardly. Sheets of paper S stacked on the knock-up plate 171*a* are transferred by a pick-up roller 172 one by one. The spring member 171*b* resiliently biases a sheet of paper S stacked on the knock-up plate 171*a* toward the pick-up roller 172. The sheets of paper S stacked on the knock-up plate 171*a* contact the pick-up roller 172 due to the upward biasing of the spring member 171*b* and are transferred one by one from the paper feeding cassette 171 by the pick-up roller 172.

Feed rollers 174 feed a sheet of paper S drawn out from the paper feeding cassette 171 by the pick-up roller 172 to the print unit 160. The fed sheet of paper S passes through the print unit 160, and a toner image is transferred onto the sheet of paper S. The toner image transferred onto the paper S is fixed by the fuser 150 and the paper S is discharged out of the image forming apparatus by the discharging rollers 176.

The process of forming a color image with the above structure is described hereafter.

Color image information includes information on cyan (C), magenta (M), yellow (Y) and black (K) colors. In an exemplary embodiment of the present invention, a color image is formed by transferring toner images of respective cyan, magenta, yellow and black colors to a sheet of paper S, preferably in this order, and then fixing the toner images.

The photoreceptor drum 111 of each developer cartridge 110C, 110M, 110Y and 110K is charged to a uniform electrostatic potential by applying a charging bias voltage to the electrostatic charging roller 113. The four scanning units 130C, 130M, 130Y and 130K form an electrostatic latent image by radiating light corresponding to image data of respective cyan, magenta, yellow and black colors onto the photoreceptor drum 111 of each developer cartridge 110C, 110M, 110Y and 110K through the openings 117 therein. When the light is radiated, static electricity on a part of the photoreceptor drum 111 where the light is radiated is selectively removed, and thereby an electrostatic potential thereon is lowered. The potential difference causes an output pattern, thereby forming the electrostatic latent image.

The supply roller 114 adheres toner to the developing roller 112 to which a developing bias voltage has been applied. The toner layer regulating member 116 makes the toner adhere to the outer circumference of the developing roller 112 with a uniform thickness. At this time, the toner is charged by friction between the developing roller 112 and the toner layer regulating member 116. The toner adhered to the outer circumference of the developing roller 112 adheres to the electrostatic latent image formed on the outer surface of the photoreceptor drum 111, and consequently toner images of respective cyan, magenta, yellow and black colors are formed on the photoreceptor drum 111 by each of the developer cartridge 110C, 110M, 110Y and 110K.

A sheet of paper S is picked out from the paper feeding cassette 171 by the pick-up roller 172, transferred through a predetermined paper transfer path 180, and then discharged out of the image forming apparatus by the discharging rollers 176. More specifically, the pick-up roller 172 circulates while pressing upper surface of the paper S which is stacked on the knock-up plate 171*a*, thereby transferring the paper S from the knock-up plate 171*a* to the feed rollers 174. The sheet of paper S picked up by the pick-up roller 172 passes through the feed rollers 174 and is transferred to the conveying belt 120. The sheet of print paper S is adhered to the surface of the conveying belt 120 by static electricity and fed at the same speed as that of the conveying belt 120. For example, a front end of paper reaches a transfer nip of the transfer roller 140 about the same time that a front end of a cyan (C) toner image formed on the outer surface of the photoreceptor drum 111 of the developer cartridge 110C arrives at the transfer nip of the transfer roller 140.

When a transfer bias voltage is applied to the transfer rollers 140, the toner images formed on the photoreceptor drums 111 are transferred to the sheet of paper S. As the sheet of print paper is fed, the magenta (M), yellow (Y) and black (K) toner images formed on the photoreceptor drum 111 by the developer cartridges 110M, 110Y and 110K are sequentially transferred to the sheet of paper S in an overlapping manner, thereby forming a color toner image on the sheet of paper S.

After transferring, toner remaining on the outer surface of the photoreceptor drum 111 is removed by the cleaning member. The fuser 150 fixes the color toner image formed on the sheet of paper by applying pressure and heat. The sheet of paper S to which the toner image has been fixed is discharged out of the image forming apparatus by the discharging rollers 176. The sheet of paper S discharged by the discharging rollers 176 is stacked on the stacking portion 190.

The paper feeding device 170 of the image forming apparatus is described in detail hereafter.

Figure 5:
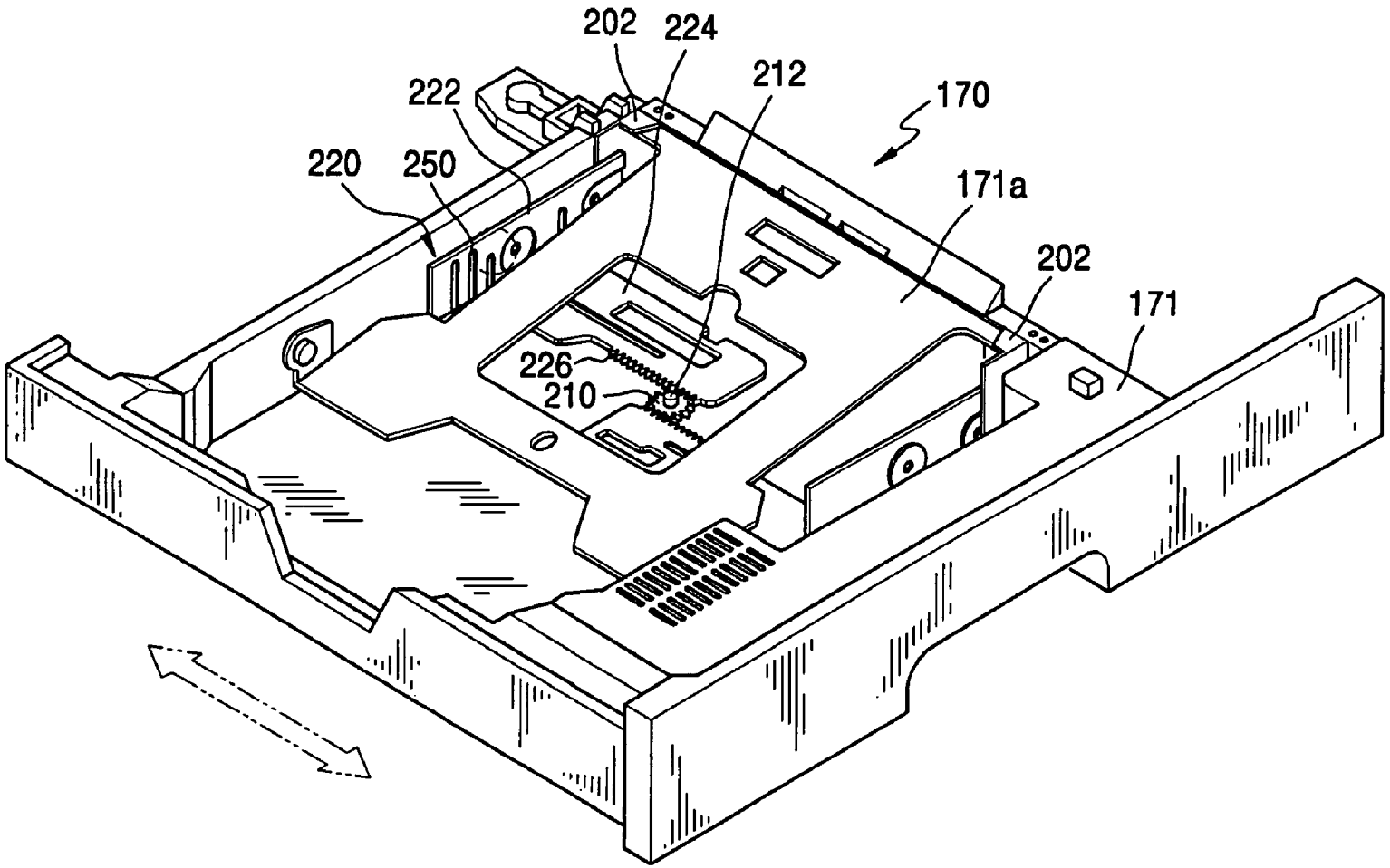
FIG. 5 is a perspective view of the paper feeding device according to an exemplary embodiment of the present invention.

FIG. 5 is a perspective view of the paper feeding device 170 according to an exemplary embodiment of the present invention.

Figure 7:
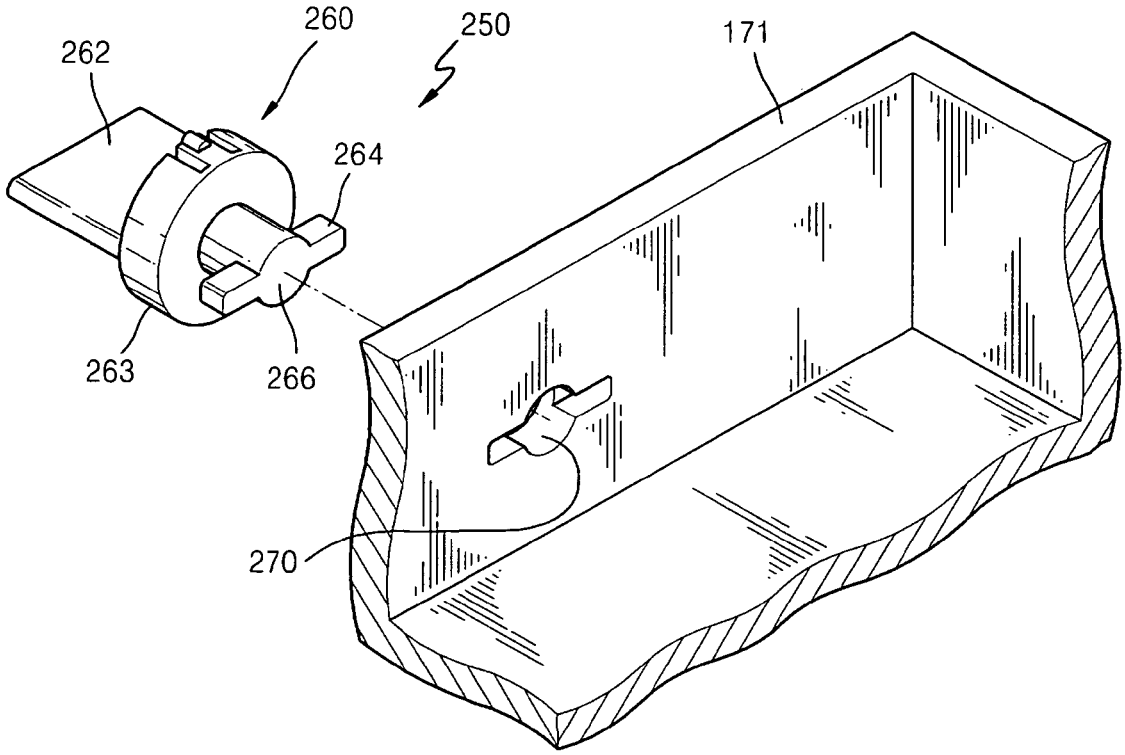
FIG. 7 is a perspective view of a support unit according to an exemplary embodiment of the present invention.

Referring to FIG. 5, the paper feeding device 170 includes a paper feeding cassette 171, a pinion gear 210, a guide member 220, and a support unit 250 (referring to FIG. 7). The paper feeding device 170 is installed and removed in a direction substantially perpendicular to the direction in which a sheet of paper S is transferred by the pick-up roller 172.

As described above, the paper feeding cassette 171 includes the knock-up plate 171*a* and a spring member 171*b*. Fingers 202, which are used to separate paper, are installed in the paper feeding cassette 171. Each of the fingers 202 is mounted on a front end of both sides of the paper feeding cassette 171 and separates sheets of paper S transferred by the pick-up roller 172 one by one. The fingers 202, which are one of the paper separation means to allow the pick-up roller to pick up sheets of papers S sheet-by-sheet, are well known to those of ordinary skill in the art, and therefore, a detailed description thereof is omitted.

Figure 6:
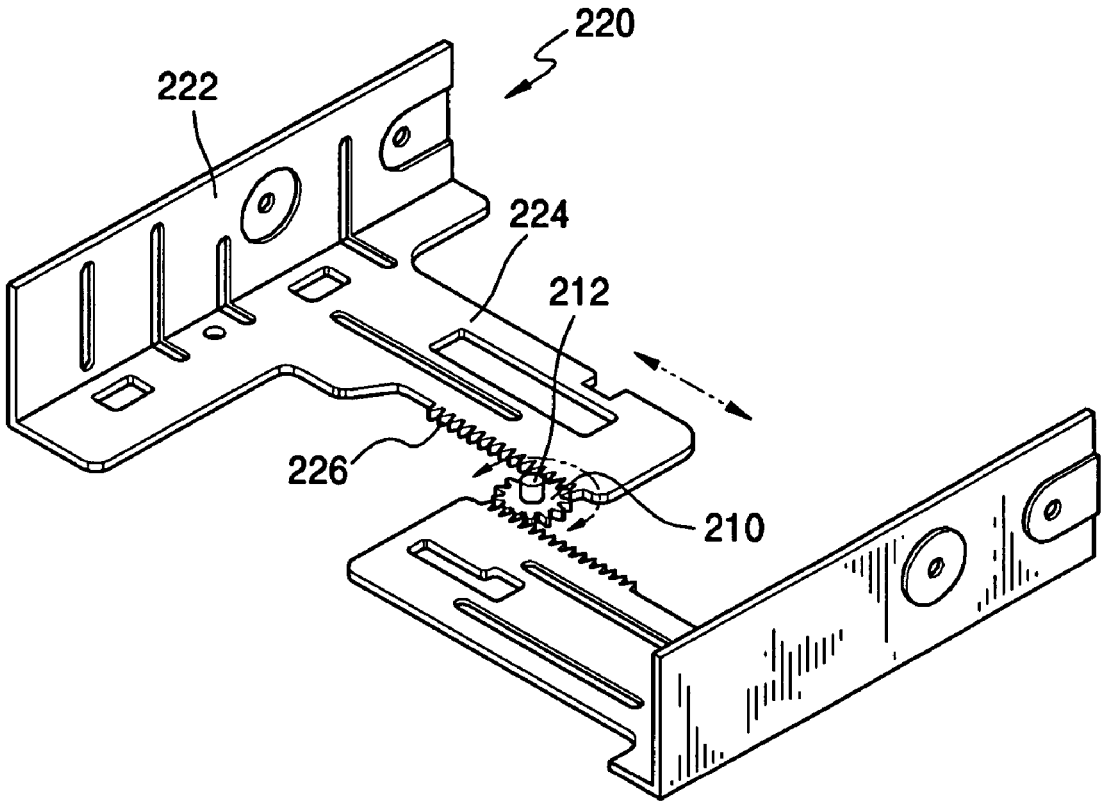
FIG. 6 is a perspective view of a pinion gear and a guide member of the paper feeding device of FIG. 5.

FIG. 6 is a perspective view of the pinion gear 210 and guide member 220 of the paper feeding device of FIG. 5.

Referring to FIG. 6, the pinion gear 210 is rotatably installed on the bottom surface of the paper feeding cassette 171. The pinion gear 210 is rotatably connected to a boss 212 that is disposed on the lower surface of the knock-up plate 171*a*. The boss 212 is preferably secured to the knock-up plate 171*a* by a fastener, such as a screw (not shown).

The guide member 220 guides a side end of stacked paper S. The guide member 220 is connected to the pinion gear 210 and slides rearwardly and forwardly, as indicated by the directional arrow in FIG. 6, to guide the side end of the stacked paper S according to the size of the paper S. That is, the guide member 220 guides the side end of the paper S when the pick-up roller 172 transfers the sheet of paper S. The guide member 220 includes a pair of guide units 222 that guide both side ends of a sheet of paper S and a sliding unit 224 extended from the guide unit 222. A rack gear 226 that engages the pinion gear 210 is formed on one side of the sliding unit 224.

When one of a pair of guide units 222 is moved to guide a sheet of paper S that is stacked, the other guide unit 222 is correspondingly moved as the pinion gear 210 rotates. Although not illustrated in the drawings, a protrusion unit is formed on a rear surface of the sliding unit 224 to guide the guide member 220 to slide rearwardly and forwardly in a width direction of a sheet of paper S. The protrusion unit is inserted in a slot formed on the paper feeding cassette 171.

After sheets of paper S are stacked on the knock-up plate 171*a*, the guide units 222 are moved in a width direction of the sheet of paper S. According to the above structure, once one of the guide units 222 is moved, the other guide unit 222 is also moved by the rack gear 226 that engages the pinion gear 210. Therefore, both sides of the sheet of paper S transferred by the pick-up roller 172 are guided by the pair of guide units 222 and transferred without skew.

FIG. 7 is a perspective view of the support unit 250 according to an exemplary embodiment of the present invention.

Referring to FIG. 7, the support unit 250 supports one side of the guide member 220, that is, one side of the guide unit 222 corresponding to the size of a sheet of paper to be stacked. The support unit 250 includes at least one connection hole 270 and a guide stopper 260 that is inserted in and connected to the connection hole 270.

The connection hole 270 is formed to penetrate a sidewall of the paper feeding cassette 171. As described above, the guide member 220 is installed to slide in a width direction of a sheet of paper S to guide both sides of the paper S to be stacked. That is, the guide member 220 slides in a direction substantially parallel to the installation and removal direction of the paper feeding cassette 171 and guides both sides of the paper S at a position corresponding to the size of the paper S.

Since sheets of paper of various sizes are stacked on the paper feeding cassette 171, a predetermined gap is present between one side of the guide member 220, that is, the one side of the guide unit 222 and a sidewall of the paper feeding cassette 171. When the paper feeding cassette 171 is installed in the image forming apparatus, the side of sheets of paper S contacts the guide unit 222 due to inertia of the paper S and the guide unit 222 is pushed and shaken, thereby causing the guide unit 222 to move. At this time, a sheet of paper S breaks away from the fingers 202, and the fingers 202 do not perform the paper separation function any more.

Therefore, if one side of the guide unit 222 is fixed and supported, the sheet of paper S may be prevented from breaking away. That is, when the gap between one side of the guide unit 222 and the sidewall of the paper feeding cassette 171 is removed, the sheet of paper S is prevented from breaking away from the fingers 202. The guide stopper 260 contacts and supports a side of the guide unit 222, thereby removing the gap.

The guide stopper 260 is installed to contact and support a side of the guide unit 222 regardless of the size of a sheet of paper S stacked on the paper feeding cassette 171. That is, the guide stopper 260 contacts and supports a side of the guide unit 222 that slides to a predetermined position according to the size of the stacked paper S.

The guide stopper 260 removes the gap between the one side of the guide unit 222 and the sidewall of the paper feeding cassette 171.

The gap between a side of the guide unit 222 and the sidewall of the paper feeding cassette 171 may not exist when the largest sheets of paper S are stacked on the paper feeding cassette 171. That is, the sidewall of the paper feeding cassette 171 may be formed such that the side of the guide unit 222 contacts the sidewall of the paper feeding cassette 171 when sheets of paper S of the maximum size that may be contained are stacked on the cassette 171. Here, the sidewall of the paper feeding cassette 171 functions as the guide stopper 260.

Figure 8:
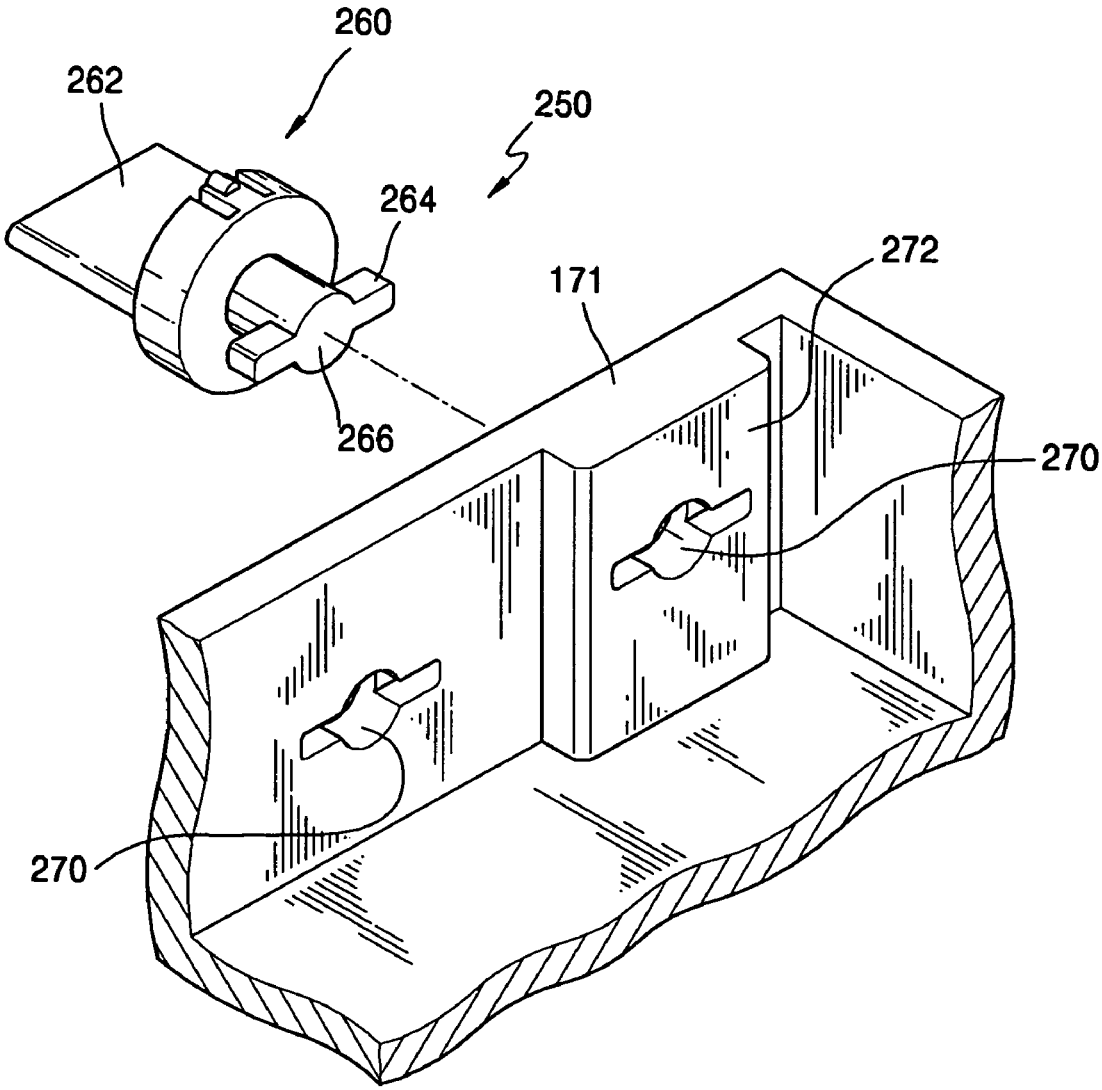
FIG. 8 is a perspective view of a support unit according to another exemplary embodiment of the present invention.
Figure 9:
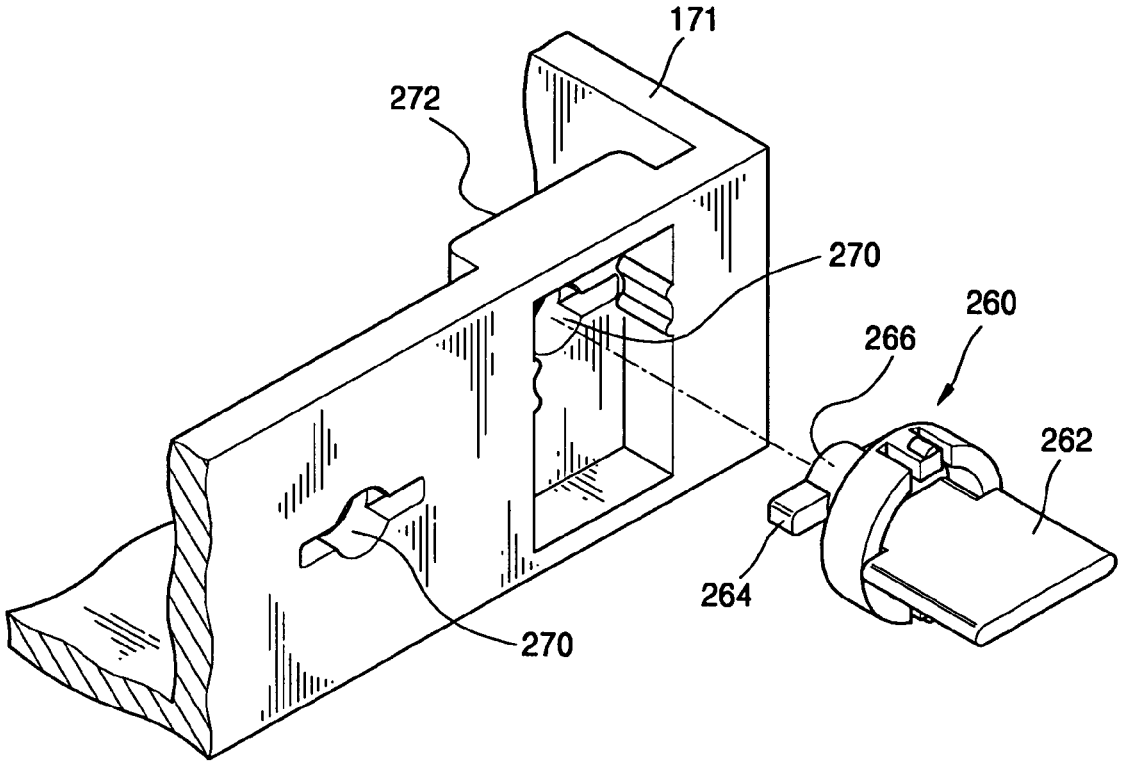
FIG. 9 is another perspective view of the support unit of FIG. 8.

FIG. 8 is a perspective view of the support unit 250 according to another exemplary embodiment of the present invention. FIG. 9 is another perspective view of the support unit 250 of FIG. 8, viewed from a different angle.

Referring to FIGS. 8 and 9, at least one protruding portion 272 is formed on a sidewall of the paper feeding cassette 171 to protrude in a direction in which sheets of paper S are stacked. The protruding portion 272 may be properly formed such that the guide stopper 260 contacts and supports the guide unit 222 in consideration of the size and type of sheets of paper S to be stacked. Further, some of connection holes 270 may be formed on the protruding portion 272. Accordingly, the guide stopper 260 is connected to the connection hole 270 formed on the protruding portion 272 that corresponds to the size of the stacked sheets of paper S and contacts and supports one side of the guide unit 222. That is, since the guide stopper 260 is connected to the connection hole 270 formed on each protruding portion 272 and supports the guide unit 222, sheet of paper S may be prevented from breaking out from the cassette 171 even when sheets of paper S of various sizes are stacked.

Further, a gap between one side of the guide unit 222 and the protruding portion 272 may not exist when the largest sheet of paper S is stacked. That is, the most protruding portion 272 may be formed such that one side of the guide unit 222 contacts the most protruding portion 272 when the sheet of paper S of the largest size is stacked. Here, the protruding portion 272 formed on the sidewall of the paper feeding cassette 171 functions as the guide stopper 260.

Sheets of paper S of various sizes are stacked on the paper feeding cassette 171. The guide unit 222 slides to support and guide both sides of each sheet of paper S of various sizes. According to the above exemplary embodiment, the protruding portion 272 is formed on the sidewall of the paper feeding cassette 171 to contact and support one side of the guide unit 222 that slides in accordance with the size of the stacked sheet of paper S. Also, the guide stopper 260 is connected to the connection hole 270 formed on the protruding portion 272. However, the functions described in the above exemplary embodiment may be implemented by changing the length of the guide stopper 260 without forming the protruding portion 272 on the sidewall of the paper feeding cassette 171.

Figure 10:
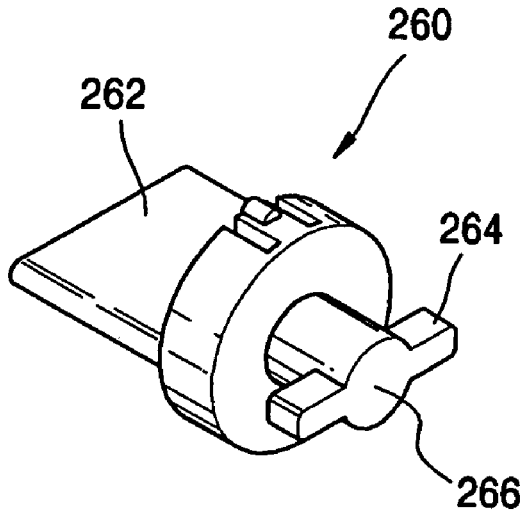
FIGS. 10 and 11 are perspective views of guide stoppers of various shapes according to exemplary embodiments of the present invention.
Figure 11:
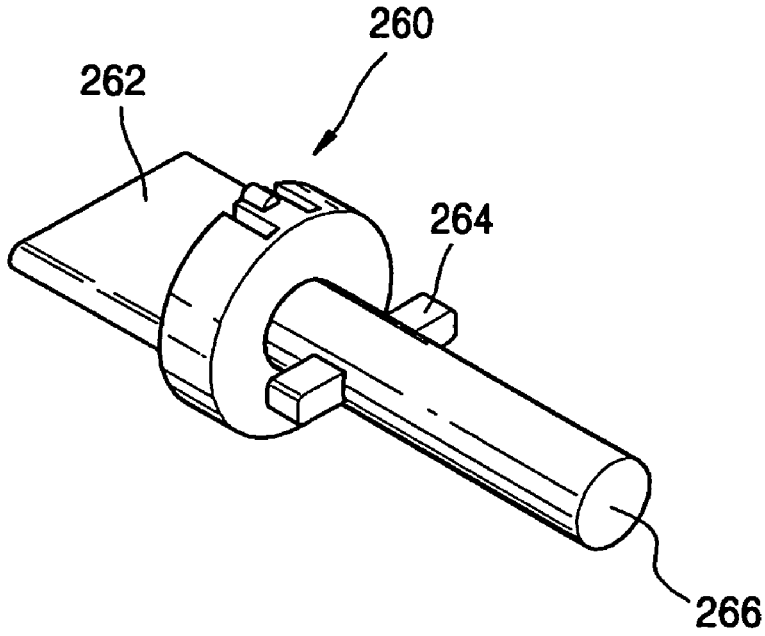

FIGS. 10 and 11 are perspective views of guide stoppers 260 having various shapes.

Referring to FIGS. 10 and 11, the guide stopper 260 includes a handle 262, a projection unit 264, and a contacting portion 266. The handle 262 is used to connect the guide stopper 260 to the connection hole 270 or to remove it from the connection hole 270. The projection unit 264 is used to secure a position of the guide stopper 260 after the guide stopper 260 is inserted to the connection hole 270. The contacting portion 266 contacts and supports one side of the guide unit 222. As illustrated in the drawings, the guide stopper 260 may be manufactured to have various lengths corresponding to the sizes of sheets of paper S to be stacked on the cassette 171. That is, when a sheet of paper S is stacked on the paper feeding cassette 171, the guide stopper 260 corresponding to a size of the sheet of paper S is connected to the connection hole 270, thereby contacting and supporting one side of the guide unit 222.

Further, a gap between one side of the guide unit 222 and the sidewall of the paper feeding cassette 171 may not exist when a sheet of paper S of a maximum size is stacked on the paper feeding cassette 171. That is, the sidewall of the paper feeding cassette 171 may be formed such that the one side of the guide unit 222 contacts the sidewall of the paper feeding cassette 171 when the sheet of paper S of the maximum size that may be contained is stacked on the cassette 171.

Figure 12:
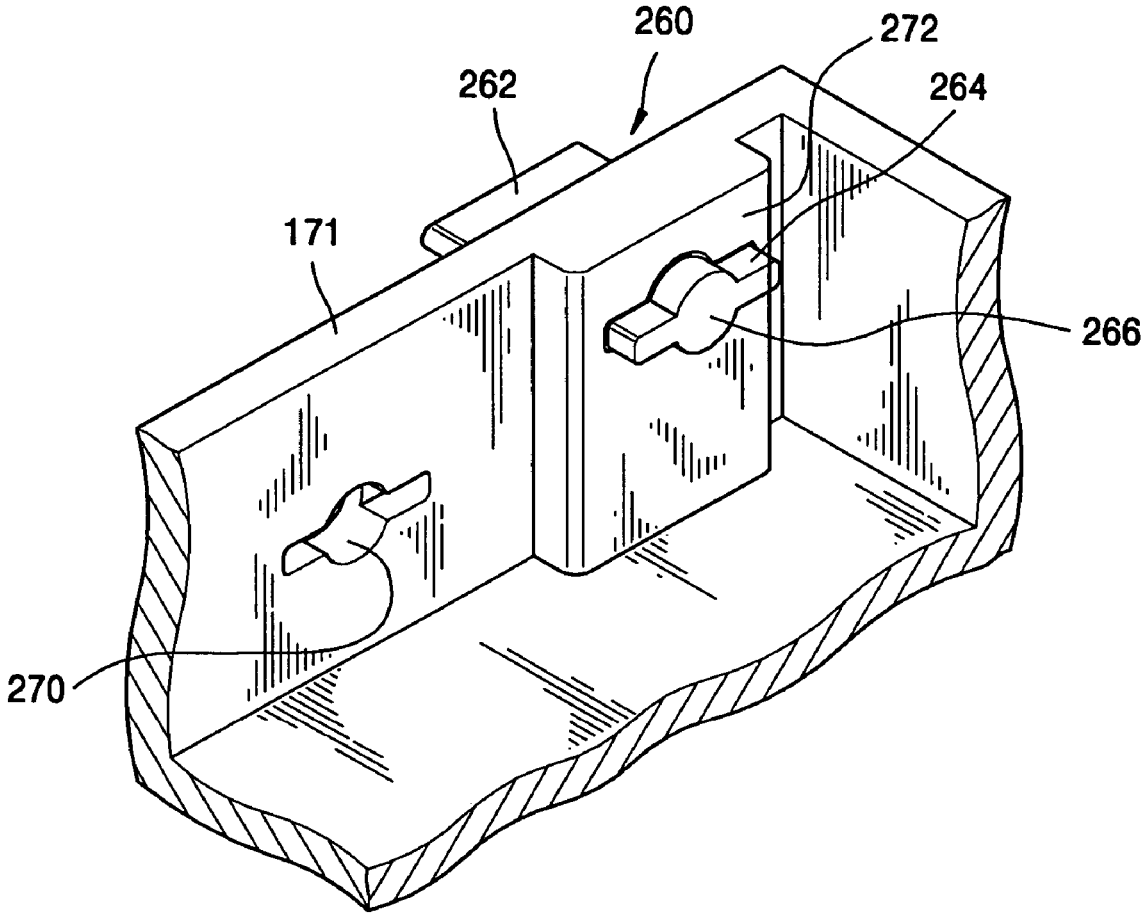
FIG. 12 is a perspective view of a guide stopper of FIG. 10 inserted in a connection hole.
Figure 13:
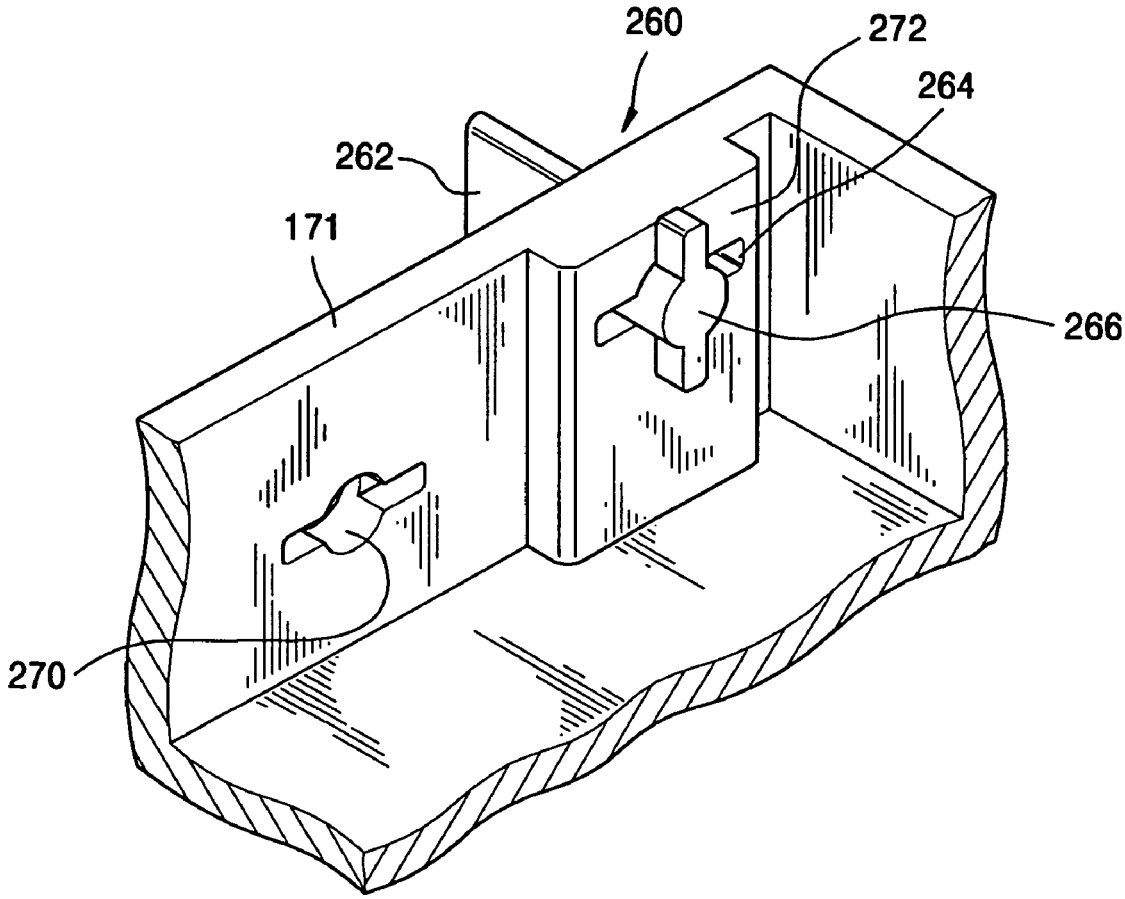
FIG. 13 is a perspective view of the guide stopper of FIG. 12 connected to the connection hole.

FIG. 12 is a perspective view showing the guide stopper 260 inserted in the connection hole 270. FIG. 13 is a perspective view showing the guide stopper 260 inserted in and then secured to the connection hole 270.

Referring FIGS. 12 and 13, the guide stopper 260 is preferably connected and disconnected to the connection hole 270 by rotational movement of the guide stopper. The guide stopper 260 is inserted in the connection hole 270, as shown in FIG. 12. When the guide stopper 260 is rotated, the position of the guide stopper 260 is secured by the projection units 264 formed on the guide stopper 260, as shown in FIG. 13. That is, the guide stopper 260 is prevented from being separated from the connection hole 270 by the projection units 264.

Figure 14:
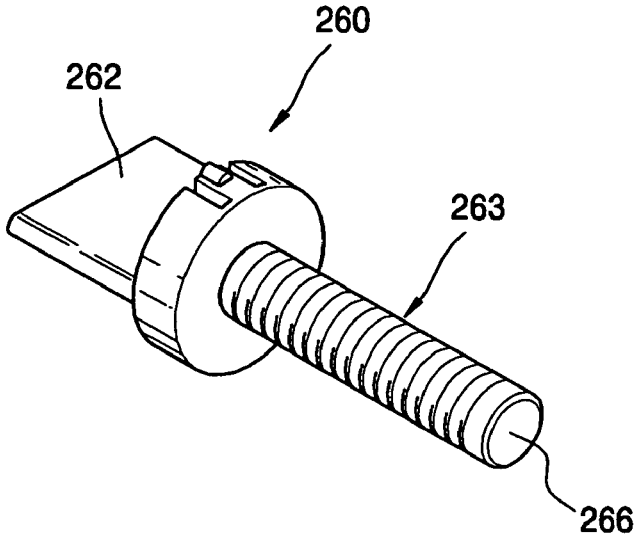
FIG. 14 is a view of a guide stopper according to another exemplary embodiment of the present invention.

FIG. 14 is a perspective view of the guide stopper 260 according to another exemplary embodiment.

Referring to FIG. 14, the guide stopper 260 is preferably screw-connected to the connection hole 270 and installed to move rearwardly and forwardly in substantially the same direction as the guide unit 222 slides. That is, the guide stopper 260 is preferably a male screw. Although not illustrated in the drawings, the connection hole 270 is preferably a female screw adapted to receive the guide stopper 260. When the guide stopper 260 and the connection hole 270 are threadably connected, the guide stopper 260 contacts and supports the guide unit 222 at a predetermined position.

Further, a gap between one side of the guide unit 222 and a sidewall of the paper feeding cassette 171 may not be present when a sheet of paper of a maximum size is stacked. That is, the sidewall of the paper feeding cassette 171 may be formed such that the side of the guide unit 222 contacts the sidewall of the paper feeding cassette 171 when the sheet of paper of the maximum size that may be contained is stacked on the cassette 171. Here, the sidewall of the paper feeding cassette 171 functions as the guide stopper 260.

Figure 15:
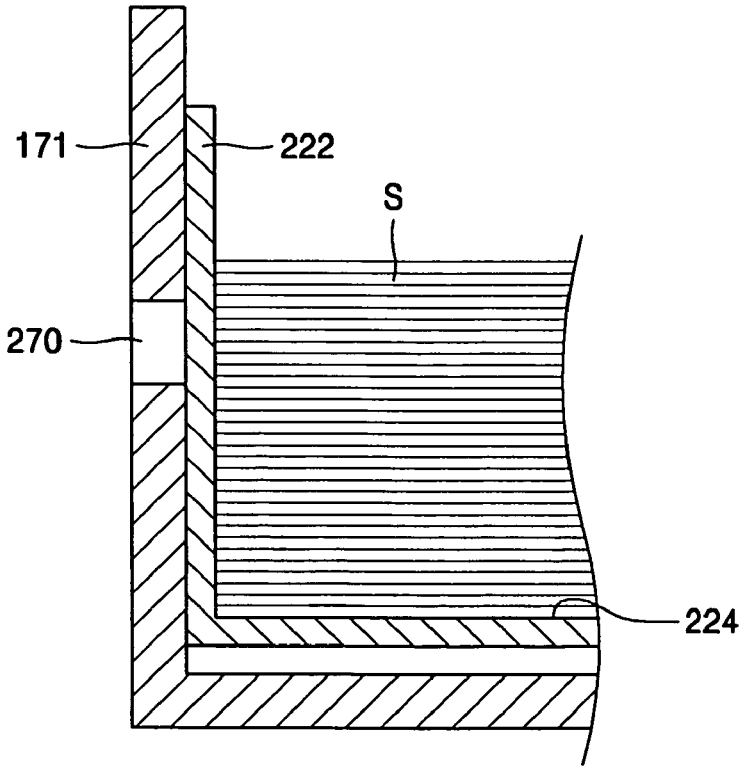
FIGS. 15 and 16 are elevational views in partial cross section of a sidewall of the paper feeding cassette and the guide stopper support the guide unit.
Figure 16:
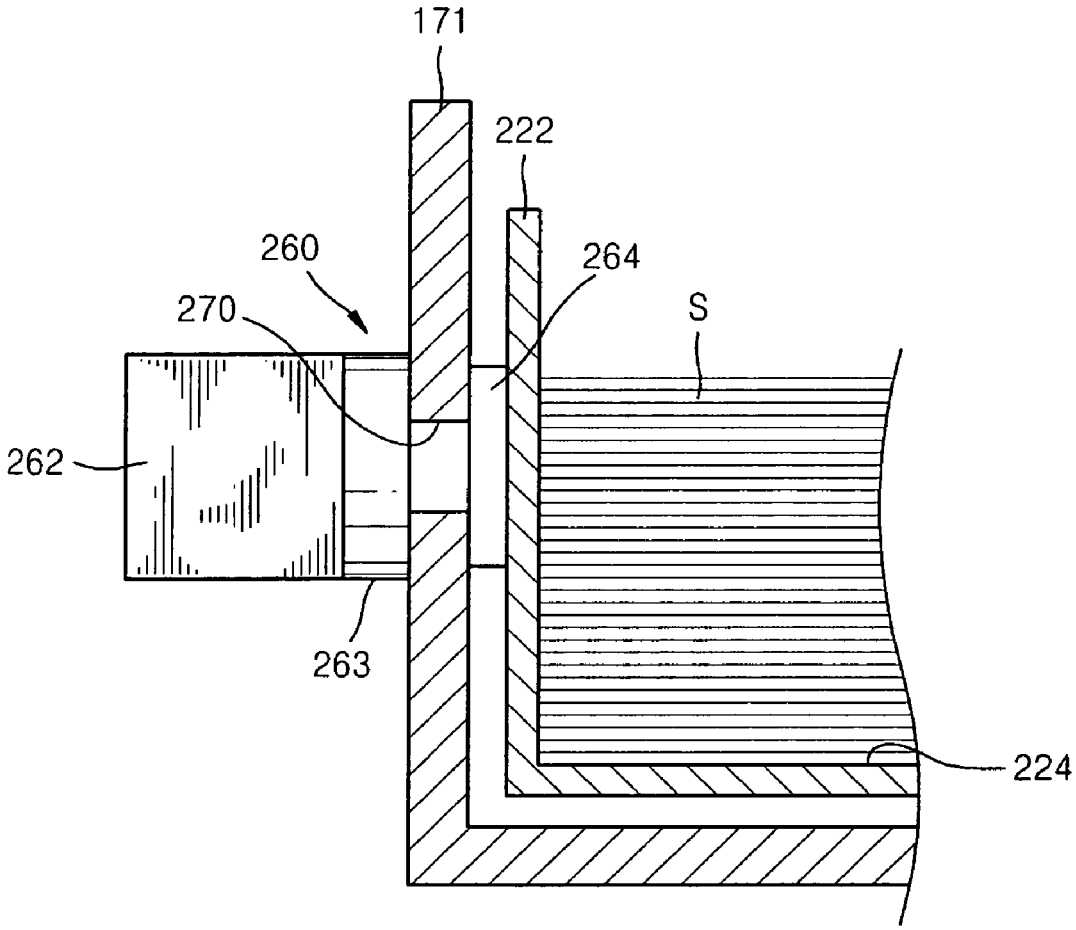

FIGS. 15 and 16 are views of the sidewall of the paper feeding cassette 171 and the contacting portion 266 of the guide stopper 260 that contacts and supports the guide unit 222, respectively. As illustrated in the drawings, the sidewall of the paper feeding cassette 171 or the guide stopper 260 contacts and supports one side of the guide unit 222. Therefore, since the sidewall of the paper feeding cassette 171 or the guide stopper 260 contacts and supports one side of the guide unit 222, the guide unit 222 may be prevented from being moved due to inertia of sheets of paper S. A member portion 263 of the guide stopper 260 prevents the guide stopper from being inserted through the paper feeding cassette 171. The member portion 263 is larger than the connection hole 270 to prevent the guide stopper 260 from being inserted through the connection hole 270.

According to the structures described above, in the present invention, a sidewall of the paper feeding cassette 171 or the guide stopper 260 contacts and supports one side of the guide unit 222 regardless of the sizes of sheets of paper S stacked on the cassette 171, thereby substantially preventing the guide unit 222 from being moved.

As described above, according to the present invention, unlike the prior art, a paper feeding device and an image forming apparatus including the paper feeding device contact and support one side of a guide unit and prevent the guide unit from being moved, and thus, a sheet of paper may be prevented from being separated from a finger during installation of a paper feeding cassette. Further, a paper jam or skew due to the separation of paper may be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A paper feeding device for an image forming apparatus, comprising:

a paper feeding cassette on which sheets of paper are stacked;

a pinion gear rotatably connected to the paper feeding cassette;

a guide member movably connected to the pinion gear and adapted to move rearwardly and forwardly in a direction of a width of the sheet of paper and guiding both sides of the sheet of paper; and a support unit supporting one side of the guide member that substantially corresponds to a size of the stacked sheets of paper, the support unit including a guide stopper having a device extending outwardly from a side wall of the paper feeding cassette to facilitate engaging the guide stopper with the paper feeding cassette, a member portion preventing the outwardly extending device from being inserted through the side wall of the paper feeding cassette, at least one connection hole extends horizontally through a sidewall of the paper feeding cassette that penetrates the sidewall, and the guide stopper inserted in and secured to the at least one connection hole and contacting and supporting one side of the guide member according to a size of the stacked sheets of paper.

2. The paper feeding device of claim 1, wherein the guide member includes a pair of guide units guiding both sides of the sheet of paper.

3. The paper feeding device of claim 2, wherein the paper feeding cassette is installed in and removed from the image forming apparatus in a direction substantially perpendicular to the direction of paper travel.

4. The paper feeding device of claim 3, wherein the sidewall of the paper feeding cassette is formed such that one side of the guide unit contacts the sidewall of the paper feeding cassette and guides a side of a sheet of paper when the sheets of paper of the maximum size receivable by the cassette are stacked in the cassette.

5. The paper feeding device of claim 3, wherein a protruding portion is formed on the sidewall of the paper feeding cassette to protrude in a direction in which the sheets of paper are stacked, and at least one connection hole is formed in the protruding portion.

6. The paper feeding device of claim 5, wherein the protruding portion is formed such that one side of the guide unit contacts the protruding portion and guides a side of a sheet of paper when the sheets of paper of the maximum size receivable by the cassette are stacked in the cassette.

7. The paper feeding device of claim 3, wherein the guide stopper has various lengths corresponding to the size of the stacked sheets of paper.

8. The paper feeding device of claim 7, wherein one side of the guide unit contacts the sidewall of the paper feeding cassette and guides a side of a sheet of paper when the sheets of paper of the maximum size receivable by the cassette are stacked in the cassette.

9. The paper feeding device of claim 8, wherein the guide stopper is locked in and disconnected from the connection hole by rotational movement of the guide stopper.

10. The paper feeding device of claim 3, wherein the guide stopper is threadably connected to the connection hole and installed to move rearwardly and forwardly in a direction substantially parallel to the direction in which the guide unit moves.

11. The paper feeding device of claim 10, wherein one side of the guide unit contacts the sidewall of the paper feeding cassette and guides a side of a sheet of paper when the sheets of paper of the maximum size receivable by the cassette are stacked in the cassette.

12. An image forming apparatus including a paper feeding device that provides a sheet of paper, the paper feeding device comprising:

a paper feeding cassette on which sheets of paper are stacked;

a pinion gear rotatably connected to the paper feeding cassette;

a pair of guide units movably connected to the pinion gear and adapted to move rearwardly and forwardly in a direction of a width of the sheet of paper and guiding both sides of the sheet of paper; and a support unit supporting one side of the guide unit, the support unit including a guide stopper having a device extending outwardly from a side wall of the paper feeding cassette to facilitate engaging the guide stopper with the paper feeding cassette, a member portion preventing the outwardly extending device from being inserted through the side wall of the paper feeding cassette, at least one connection hole extends horizontally through a sidewall of the paper feeding cassette that penetrates the sidewall, and the guide stopper inserted in and secured to the connection hole and contacting and supporting one side of the guide unit according to a size of the stacked sheets of paper.

13. The image forming apparatus of claim 12, wherein one side of the guide unit contacts the sidewall of the paper feeding cassette and guides a side of a sheet of paper when the sheets of paper of the maximum size receivable by the cassette are stacked in the cassette.

14. The image forming apparatus of claim 12, wherein a protruding portion is formed on the sidewall of the paper feeding cassette to protrude in a direction in which the sheet of paper is stacked, and at least one of the connection holes is formed in the protruding portion.

15. The image forming apparatus of claim 14, wherein one side of the guide unit contacts the protruding portion and guides a side of a sheet of paper when the sheets of paper of the maximum size receivable by the cassette are stacked in the cassette.

16. The image forming apparatus of claim 12, wherein the guide stopper has various lengths corresponding to the size of the stacked sheets of paper.

17. The image forming apparatus of claim 12, wherein the guide stopper is threadably connected to the connection hole and adapted to move rearwardly and forwardly in a direction substantially parallel to the direction in which the guide unit moves.

18. The image forming apparatus of claim 12, wherein the guide stopper is locked in and disconnected from the connection hole by rotational movement of the guide stopper.

19. A paper feeding device for an image forming apparatus, comprising:

a paper feeding cassette on which sheets of paper are stacked;

a pinion gear rotatably connected to the paper feeding cassette;

a guide member movably connected to the pinion gear and adapted to move rearwardly and forwardly in a direction of a width of the sheet of paper and guiding both sides of the sheet of paper; and a support unit supporting one side of the guide member that substantially corresponds to a size of the stacked sheets of paper, the support unit including a guide stopper having a device extending outwardly from a side wall of the paper feeding cassette to facilitate engaging the guide stopper with the paper feeding cassette, a member portion preventing the outwardly extending device from being inserted through the side wall of the paper feeding cassette, the guide stopper passing through an opening that extends horizontally through the sidewall of the paper feeding cassette, and a portion of the guide stopper disposed in the sidewall opening being substantially entirely surrounded by the sidewall of the paper feeding cassette to stably retain the guide stopper therein.

20. An image forming apparatus including a paper feeding device that provides a sheet of paper, the paper feeding device comprising:

a paper feeding cassette on which sheets of paper are stacked;

a pinion gear rotatably connected to the paper feeding cassette;

a pair of guide units movably connected to the pinion gear and adapted to move rearwardly and forwardly in a direction of a width of the sheet of paper and guiding both sides of the sheet of paper; and a support unit supporting one side of the guide unit, the support unit including a guide stopper having a device extending outwardly from a side wall of the paper feeding cassette to facilitate engaging the guide stopper with the paper feeding cassette, a member portion preventing the outwardly extending device from being inserted through the side wall of the paper feeding cassette, the guide stopper passing through an opening that extends horizontally through the sidewall of the paper feeding cassette, and a portion of the guide stopper disposed in the sidewall opening being substantially entirely surrounded by the sidewall of the paper feeding cassette to stably retain the guide stopper therein.

* * * * *